US009842546B2

(12) United States Patent
Kim et al.

(10) Patent No.: US 9,842,546 B2
(45) Date of Patent: Dec. 12, 2017

(54) ORGANIC LIGHT EMITTING DISPLAY DEVICE FOR IMPROVING A CONTRAST RATIO

(71) Applicant: LG DISPLAY CO., LTD., Seoul (KR)

(72) Inventors: Bum Sik Kim, Suwon-si (KR); Seung Tae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 20 days.

(21) Appl. No.: 14/459,897

(22) Filed: Aug. 14, 2014

(65) Prior Publication Data

US 2015/0062192 A1 Mar. 5, 2015

(30) Foreign Application Priority Data

Aug. 30, 2013 (KR) ..... 10-2013-0104185

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0452* (2013.01); *G09G 2300/0842* (2013.01)

(58) Field of Classification Search
CPC ..... G09G 3/3291; G09G 3/2003; G09G 3/30; G09G 3/36; G09G 5/00; G06F 3/038
USPC ..... 345/690
See application file for complete search history.

(56) References Cited

U.S. PATENT DOCUMENTS

2003/0117348 A1 6/2003 Knapp et al.
2008/0170020 A1* 7/2008 Kim ..... G09G 3/2011 345/89
2008/0259064 A1 10/2008 Chiou
2010/0225676 A1* 9/2010 Nishimura ..... G09G 3/3688 345/690
2011/0057966 A1 3/2011 Ono
2011/0205221 A1* 8/2011 Lin ..... G09G 3/2092 345/213

(Continued)

FOREIGN PATENT DOCUMENTS

CN 1605093 A 4/2005
CN 101290741 A 10/2008

(Continued)

*Primary Examiner* — Pegeman Karimi
(74) *Attorney, Agent, or Firm* — Birch, Stewart, Kolasch & Birch, LLP

(57) ABSTRACT

Discussed is an organic light emitting display device. The organic light emitting display device in one embodiment includes a plurality of pixels configured to each include an organic light emitting device which emits light with a data current, and a pixel circuit that includes a driving transistor which supplies the data current, which is based on a difference voltage between a data voltage and a reference voltage, to the organic light emitting device, a plurality of data lines configured to respectively supply a plurality of the data voltages to the plurality of pixels, a plurality of gate lines configured to supply a gate signal to the pixels, and a plurality of reference lines connected to at least one of the pixels, and configured to supply the reference voltage to the connected pixel. The reference voltage is varied according to data of a pixel connected to a corresponding reference line.

12 Claims, 10 Drawing Sheets

(56) References Cited

U.S. PATENT DOCUMENTS

| | | | | |
|---|---|---|---|---|
| 2012/0242680 | A1* | 9/2012 | Park | G09G 3/3233 345/590 |
| 2012/0320024 | A1 | 12/2012 | Ebisuno et al. | |
| 2013/0050292 | A1 | 2/2013 | Mizukoshi | |
| 2013/0147690 | A1* | 6/2013 | Kim | G09G 3/3233 345/76 |
| 2013/0147694 | A1 | 6/2013 | Kim et al. | |
| 2013/0162617 | A1 | 6/2013 | Yoon et al. | |
| 2015/0084946 | A1* | 3/2015 | Shim | G09G 3/3258 345/212 |

FOREIGN PATENT DOCUMENTS

| | | | |
|---|---|---|---|
| CN | 102150196 | A | 8/2011 |
| CN | 102959611 | A | 3/2013 |
| CN | 102968954 | A | 3/2013 |
| CN | 103165079 | A | 6/2013 |
| CN | 103177685 | A | 6/2013 |
| KR | 10-2012-0076215 | A | 7/2012 |
| KR | 10-2013-0030598 | A | 3/2013 |
| KR | 10-2013-0060476 | A | 6/2013 |
| KR | 10-2013-0066449 | A | 6/2013 |

* cited by examiner

ORGANIC LIGHT EMITTING DISPLAY DEVICE FOR IMPROVING A CONTRAST RATIO

CROSS-REFERENCE TO RELATED APPLICATIONS

This application claims the benefit of the Korean Patent Application No. 10-2013-0104185 filed on Aug. 30, 2013, which is hereby incorporated by reference as if fully set forth herein.

BACKGROUND

Field of the Invention

The present invention relates to an organic light emitting display device, and more particularly, to an organic light emitting display device for improving a contrast ratio.

Discussion of the Related Art

Recently, with the advancement of multimedia, the importance of flat panel display (FPD) devices is increasing. Therefore, various FPD devices such as liquid crystal display (LCD) devices, plasma display panel (PDP) devices, and organic light emitting display devices are being used practically. In such FPD devices, the organic light emitting display devices have a fast response time of 1 ms or less and low power consumption, and have no limitation in a viewing angle because the organic light emitting display devices self-emit light. Accordingly, the organic light emitting display devices are attracting much attention as next generation FPD devices.

A related art organic light emitting display device includes a plurality of pixels that display an image. Each of the plurality of pixels includes an organic light emitting layer, which is formed between an anode electrode and a cathode electrode, and a pixel circuit that emits light from an organic light emitting device. The pixel circuit includes a switching transistor, a driving transistor, and a capacitor. The switching transistor is turned on according to a switching signal to supply a data voltage to the driving transistor. The driving transistor is turned on with the data voltage supplied from the switching transistor, and controls a current flowing to the organic light emitting device to control emission of light from the organic light emitting device. The capacitor stores a voltage between a gate electrode and source electrode of the driving transistor, and turns on the driving transistor by using the stored voltage. The organic light emitting device emits light with a current supplied from the driving transistor.

However, in the related art organic light emitting display device, a characteristic difference (such as a threshold voltage (Vth) and mobility) of the driving transistor occurs due to a process differential, and for this reason, the amount of current driving the organic light emitting device is changed, causing a luminance deviation between pixels. Generally, the characteristic difference of the driving transistor causes a smear or a pattern to a screen, and a characteristic difference due to a deterioration of the organic light emitting device which is caused by long-time driving reduces a service life of an organic light emitting display panel or causes image sticking. As a method for solving a problem caused by a characteristic change of each pixel, internal compensation technology and external compensation technology are known.

The internal compensation technology adds a compensation circuit (including at least one compensation transistor and at least one compensation capacitor) into a pixel circuit of each pixel, and compensates for a characteristic change of each pixel by using a compensation circuit. However, in the internal compensation technology, an aperture ratio of each pixel is reduced due to a compensation transistor, a compensation capacitor, and a signal line which are added into each pixel.

The external compensation technology senses a characteristic change of a pixel from the outside of the pixel, and reflects the sensed characteristic change in data of the pixel to compensate for the characteristic change of the pixel. The external compensation technology is disclosed in a related art reference such as Korean Patent Publication No. 10-2013-0066449.

The related art reference, as illustrated in FIG. 1, applies a reference voltage Vref to a gate electrode n1 of a driving transistor DT through a first transistor M1 and simultaneously applies a data voltage to a source electrode n2 of the driving transistor DT through a second transistor M2, thereby emitting light from an organic light emitting device OLED. In external compensation, the related art reference applies the reference voltage Vref to the gate electrode n1 of the driving transistor DT through the first transistor M1, and senses a characteristic change of the driving transistor and/or a characteristic change of the organic light emitting device OLED through a data line D which is connected to the source electrode n2 of the driving transistor DT through the second transistor M2.

The reference voltage Vref of the related art reference is fixed as a constant direct current (DC) voltage value. Therefore, the related art reference applies a low data voltage to the source electrode n2 of the driving transistor DT so as to realize a high gray scale, and applies a high data voltage to the source electrode n2 of the driving transistor DT so as to realize a low gray scale. Therefore, in the related art reference, the data voltage is applied to the source electrode n2 of the driving transistor DT connected to the organic light emitting device OLED, and thus, when the data voltage applied to the source electrode n2 of the driving transistor DT is higher than a threshold voltage (Vth_OLED) of the organic light emitting device OLED, the organic light emitting device OLED emits light with the data voltage during a data charging period of a pixel.

FIG. 2 is a waveform diagram showing a data voltage of a unit pixel for realizing a high gray scale and a low gray scale in one unit pixel, in the related art reference.

In the related art reference, a data voltage for realizing a high gray scale and a low gray scale will be described with common reference to FIGS. 1 and 2.

First, it is assumed that the reference voltage Vref supplied to each pixel is fixed as 16V and the threshold voltage Vth_oled of the organic light emitting device OLED is 6V, and it is assumed that a high gray scale having relatively high luminance is realized in a first horizontal period 1H and a low gray scale having relatively low luminance is realized in a second horizontal period 2H.

During a data charging period of the first horizontal period 1H, a red data voltage Vdata_R of 2V, a green data voltage Vdata_G of 4V, a blue data voltage Vdata_B of 8V, and a white data voltage Vdata_W of 6V are respectively applied to the source electrodes n2 of the driving transistors DT included in respective pixels R, G, B and W. Therefore, during a data charging period of the first horizontal period 1H, a voltage (Vref−Vdata_R) of 14V, a voltage (Vref−Vdata_G) of 12V, a voltage (Vref−Vdata_B) of 8V, and a voltage (Vref−Vdata_W) of 10V are each applied between the gate electrode and source electrode of the driving transistor DT included in a corresponding pixel among the pixels R, G, B and W. Thus, in an emission period of the first horizontal period 1H, the organic light emitting device OLED of each of the pixels R, G, B and W emits light with a data current corresponding to a corresponding voltage among the voltages 14V, 12V, 8V and 10V, thereby realizing a high gray scale having high luminance. Here, in the data charging period of the first horizontal period 1H, since the blue data voltage Vdata_B applied to the blue pixel is higher than the threshold voltage Vth_oled of the organic light emitting device OLED, the organic light emitting device OLED of the blue pixel emits light during the data charging period, thereby increasing a luminance of a high gray scale.

On the other hand, during a data charging period of the second horizontal period 2H, a red data voltage Vdata_R of 16V, a green data voltage Vdata_G of 12V, a blue data voltage Vdata_B of 14V, and a white data voltage Vdata_W of 14V are respectively applied to the source electrodes n2 of the driving transistors DT included in respective pixels R, G, B and W. Therefore, during a data charging period of the second horizontal period 2H, a voltage (Vref−Vdata_R) of 0V, a voltage (Vref−Vdata_G) of 4V, a voltage (Vref−Vdata_B) of 2V, and a voltage (Vref−Vdata_W) of 2V are each applied between the gate electrode and source electrode of the driving transistor DT included in a corresponding pixel among the pixels R, G, B and W. Thus, in an emission period of the second horizontal period 1H, the organic light emitting device OLED of each of the pixels R, G, B and W emits light with a data current corresponding to a corresponding voltage among the voltages 0V, 4V, 2V and 2V, thereby realizing a low gray scale having low luminance Here, in the data charging period of the first horizontal period 1H, since the data voltages Vdata_R, Vdata_G, Vdata_B and Vdata_W respectively applied to the pixels R, G, B and W are higher than the threshold voltage Vth_oled of the organic light emitting device OLED, all the organic light emitting devices OLED of the pixels R, G, B and W emit light during the data charging period, thereby increasing a luminance of a low gray scale.

For this reason, in the related art reference, a luminance of a low gray scale increases due to undesired emission of light from the organic light emitting device OLED in realizing a low gray scale, causing a reduction in a contrast ratio.

SUMMARY

Accordingly, the present invention is directed to providing an organic light emitting display device that substantially obviates one or more problems due to limitations and disadvantages of the related art.

An aspect of the present invention is directed to providing an organic light emitting display device which can prevent a contrast ratio from being reduced due to undesired emission of light from an organic light emitting device in realizing a low gray scale.

Another aspect of the present invention is directed to providing an organic light emitting display device which can increase an aperture ratio of each pixel.

In addition to the aforesaid objects of the present invention, other features and advantages of the present invention will be described below, but will be clearly understood by those skilled in the art from descriptions below.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a plurality of pixels configured to each include an organic light emitting device which emits light with a data current, and a pixel circuit that includes a driving transistor which supplies the data current, which is based on a difference voltage between a data voltage and a reference voltage, to the organic light emitting device; a plurality of data lines configured to supply a plurality of the data voltages to the plurality of pixels, respectively; a plurality of gate lines configured to supply a gate signal to the plurality of pixels; and a plurality of reference lines connected to at least one of the plurality of pixels, and configured to supply the reference voltage to the connected pixel, wherein the reference voltage is varied according to data of a pixel connected to a corresponding reference line.

In another aspect of the present invention, there is provided an organic light emitting display device including: a display panel configured to include a plurality of pixels, which are respectively connected to a plurality of data lines receiving a data voltage, and a plurality of reference lines shared by and connected to at least two pixels among the plurality of pixels; and a data driver configured to vary a reference voltage supplied to each of the plurality of reference lines according to data of pixels sharing each of the plurality of reference lines, and correct a data voltage of each of the plurality of pixels according to the varied reference voltage to supply the corrected data voltage to a corresponding data line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Figure 1:
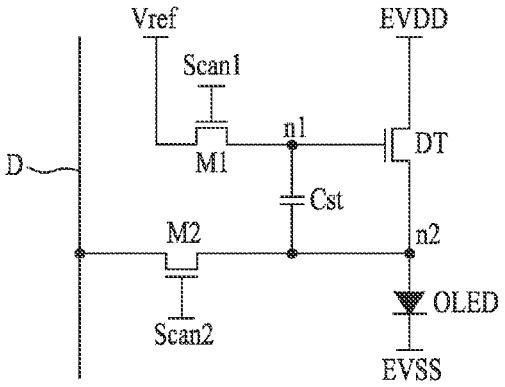
FIG. 1 Related Art
FIG. 1 is a diagram illustrating a pixel structure of a related art organic light emitting display device.
Figure 2:
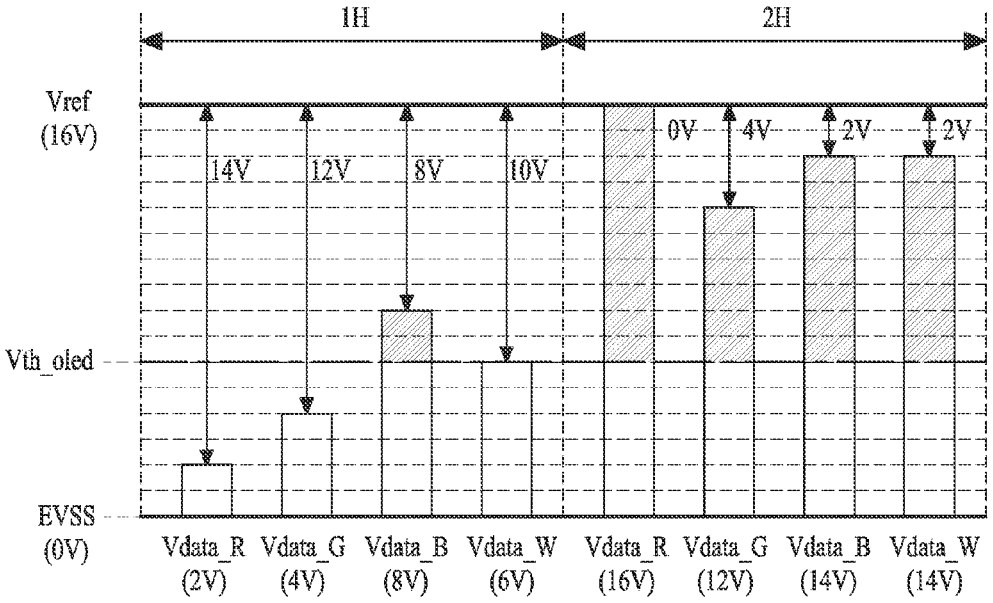
FIG. 2 Related Art
FIG. 2 is a waveform diagram showing a data voltage of a unit pixel for realizing a high gray scale and a low gray scale in one unit pixel, in the related art organic light emitting display device.

Reference will now be made in detail to the exemplary embodiments of the present invention, examples of which are illustrated in the accompanying drawings. Wherever possible, the same reference numbers will be used throughout the drawings to refer to the same or like parts.

In the specification, in adding reference numerals for elements in each drawing, it should be noted that like reference numerals already used to denote like elements in other drawings are used for elements wherever possible.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It should be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

Hereinafter, an organic light emitting display device according to embodiments of the present invention will be described in detail with reference to the accompanying drawings.

Figure 3:
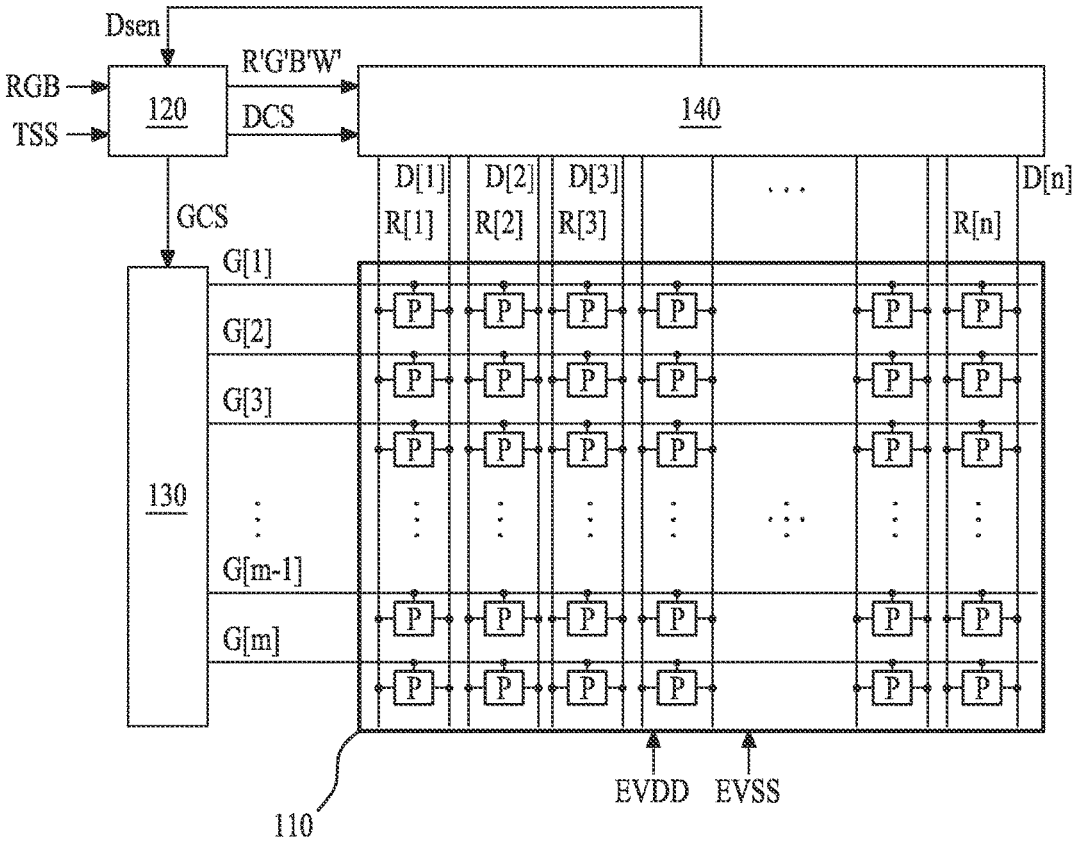
FIG. 3 is a diagram for describing an organic light emitting display device according to an embodiment of the present invention.
Figure 4:
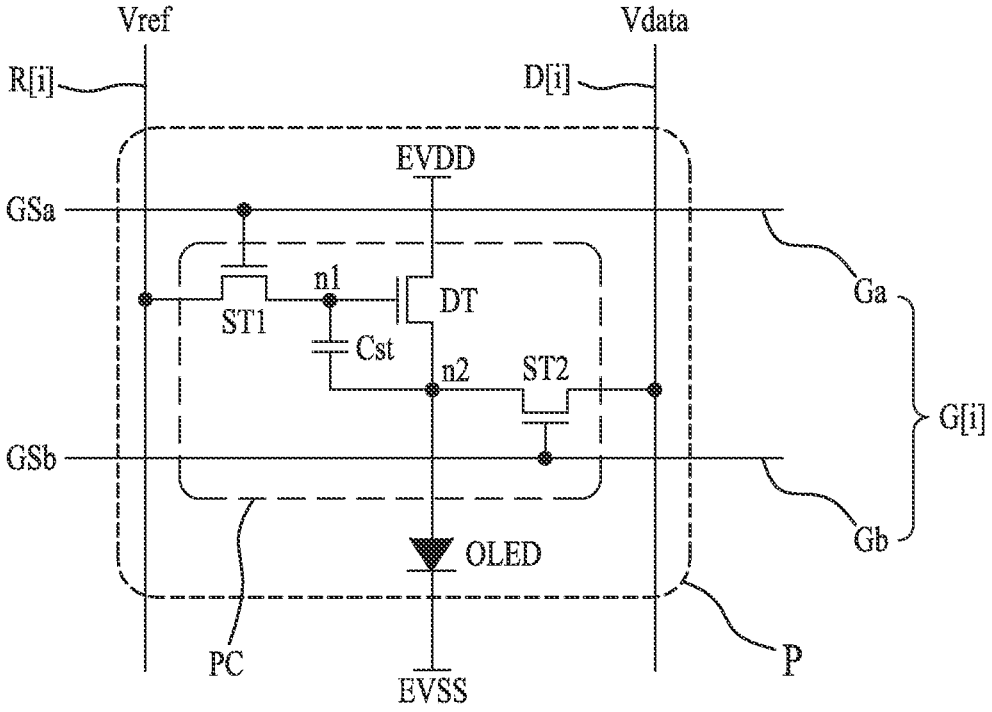
FIG. 4 is a diagram illustrating an example of a pixel of FIG. 3.

FIG. 3 is a diagram for describing an organic light emitting display device according to an embodiment of the present invention, and FIG. 4 is a diagram illustrating a pixel of FIG. 3.

Referring to FIGS. 3 and 4, the organic light emitting display device according to an embodiment of the present invention includes a display panel 110, a timing controller 120, a gate driver 130, and a data driver 140.

The display panel 110 includes a plurality of data lines D[1] to D[n], a plurality of gate lines G[1] to G[m], a plurality of reference lines R[1] to R[n], and a plurality of pixels P.

The plurality of data lines D[1] to D[n] are formed at the display panel 110 at certain intervals.

The plurality of gate lines G[1] to G[m] are formed at the display panel 110 at certain intervals to intersect the plurality of data lines D[1] to D[n]. Here, each of the plurality of gate lines G[1] to G[m] may include first and second gate signal lines Ga and Gb.

The plurality of reference lines R[1] to R[n] are formed at the display panel 110 at certain intervals to be parallel to the plurality of data lines D[1] to D[n].

Each of the plurality of pixels P may be one of a red pixel, a green pixel, a blue pixel, and a white pixel. One unit pixel displaying one image may include adjacent red pixel, green pixel, blue pixel, and white pixel, but may include adjacent red pixel, green pixel, and blue pixel without being limited thereto.

The plurality of pixels P are respectively formed in a plurality of intersection areas between the plurality of data lines D[1] to D[n], the plurality of gate lines G[1] to G[m], and the plurality of reference lines R[1] to R[n]. Therefore, each of the plurality of pixels P emits light with a data current corresponding to a difference voltage between a data voltage supplied to a corresponding data line and a reference voltage supplied to a corresponding reference line according to first and second gate signals GSa and GSb supplied to a corresponding gate line. To this end, each pixel P includes an organic light emitting device OLED and a pixel circuit PC.

The organic light emitting device OLED emits light with a data current supplied from the pixel circuit PC to emit light of luminance corresponding to the data current. To this end, the organic light emitting device OLED includes an anode electrode (not shown) connected to the pixel circuit PC, an organic layer (not shown) formed on the anode electrode, and a cathode electrode (not shown) which is formed on the organic layer to receive a cathode voltage EVSS. Here, the organic layer may be formed to have a structure of a hole transport layer/organic emission layer/electron transport layer or a structure of a hole injection layer/hole transport layer/organic emission layer/electron transport layer/electron injection layer. Furthermore, the organic layer may further include a function layer for enhancing the emission efficiency and/or service life of the organic emission layer.

The pixel circuit PC includes a first switching transistor ST1, a second switching transistor ST2, the driving transistor DT, and a capacitor Cst. Here, each of the transistors ST1, ST2 and DT is an N-type thin film transistor (TFT), and for example, may be an a-Si TFT, a poly-Si TFT, an oxide TFT, and an organic TFT.

The first switching transistor ST1 includes a gate electrode connected a first gate signal line Ga, a first electrode connected to an adjacent reference line R[i], and a second electrode connected to a first node n1 that is a gate electrode of the driving transistor DT. The first switching transistor ST1 supplies a reference voltage Vref, supplied to the reference line R[i], to the first node n1 (i.e., the gate electrode of the driving transistor DT) according to a gate signal supplied to the first gate signal line Ga.

The second switching transistor ST2 includes a gate electrode connected a second gate signal line Gb, a first electrode connected to a second node n2 that is a source electrode of the driving transistor DT, and a second electrode connected to an adjacent data line D[i]. The second switching transistor ST2 supplies a data voltage Vdata, supplied to the data line D[i], to the second node n2 (i.e., the source electrode of the driving transistor DT) according to a gate signal supplied to the second gate signal line Gb.

The capacitor Cst includes the gate electrode and source electrode of the driving transistor DT, namely, first and second electrodes respectively connected to the first and second nodes n1 and n2. The capacitor Cst is charged with a difference voltage between voltages respectively supplied to the first and second nodes n1 and n2, and then turns on the driving transistor DT with the charged voltage.

The driving transistor DT includes the gate electrode which is connected to the second electrode of the first switching transistor ST1 and the first electrode of the capacitor Cst in common, the source electrode which is connected to the first electrode of the second switching transistor ST2, the second electrode of the capacitor Cst, and an anode electrode of the organic light emitting device OLED in common, and the drain electrode connected to a driving voltage EVDD line. The driving transistor DT is turned on with a voltage of the capacitor Cst, and controls the amount of current flowing from the driving voltage EVDD line to the organic light emitting device OLED.

The timing controller 120 operates the gate driver 130 and the data driver 140 in a display mode. At a threshold voltage/mobility sensing time of a driving transistor DT which is set by a user, the timing controller 120 operates the gate driver 130 and the data driver 140 in a sensing mode. Here, the sensing mode may be performed in a test process before the product release of an organic light emitting display device, at an initial driving time of the display panel 110, or at a time when the display panel 110 is driven for a long time and then is ended, or may be performed a blank period of a frame which is set in real time or periodically.

The timing controller 120 generates a data control signal DCS and a gate control signal GCS which are used to drive each pixel P according to the display mode or the sensing mode, on the basis of a timing sync signal TSS which is input from the outside, namely, a system body (not shown) or a graphics card (not shown).

The timing controller 120 stores sensing data Dsen of each pixel P, which is supplied from the data driver 140 according to the sensing mode, in a memory (not shown). In the display mode, the timing controller 120 corrects input data RGB on the basis of sensing data Dsen stored in the memory, and supplies the corrected correction data R'G'B'W' to the data driver 140. That is, the timing controller 120 converts red, green, and blue data RGB (which are input from the outside) into four-color data RGBW of red, green, blue, and white so as to correspond to a pixel arrangement structure of the display panel 110. The timing controller 120 corrects the four-color data RGBW to four-color display data R'G'B'W' on the basis of the sensing data Dsen stored in the memory, and supplies the four-color display data R'G'B'W' to the data driver 140. In this case, the timing controller 120 may include a four color data converter (not shown) that converts three-color input data RGB into four-color data RGBW according to a conversion method disclosed in Korean Patent Publication Nos. 10-2013-0060476 and 10-2013-0030598.

The gate driver 130 sequentially generates the first and second gate signals GSa and GSb according to the gate control signal GCS supplied from the timing controller 120, and sequentially supplies the first and second gate signals GSa and GSb to the first and second gate signal lines Ga and Gb of each of the plurality of gate lines G[1] to G[m], respectively.

Figure 5:
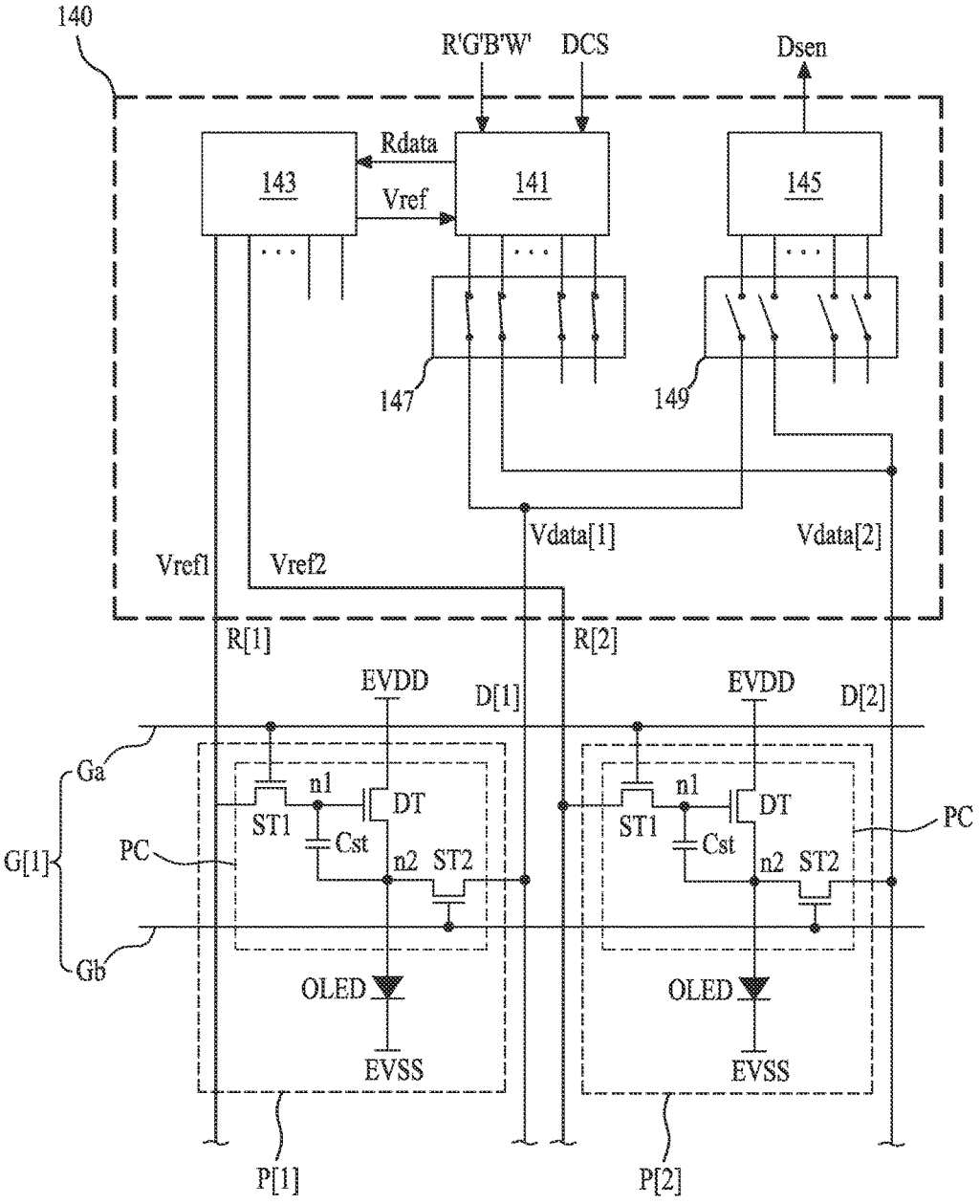
FIG. 5 is a diagram for describing an example of a data driver of FIG. 3.
Figure 6:
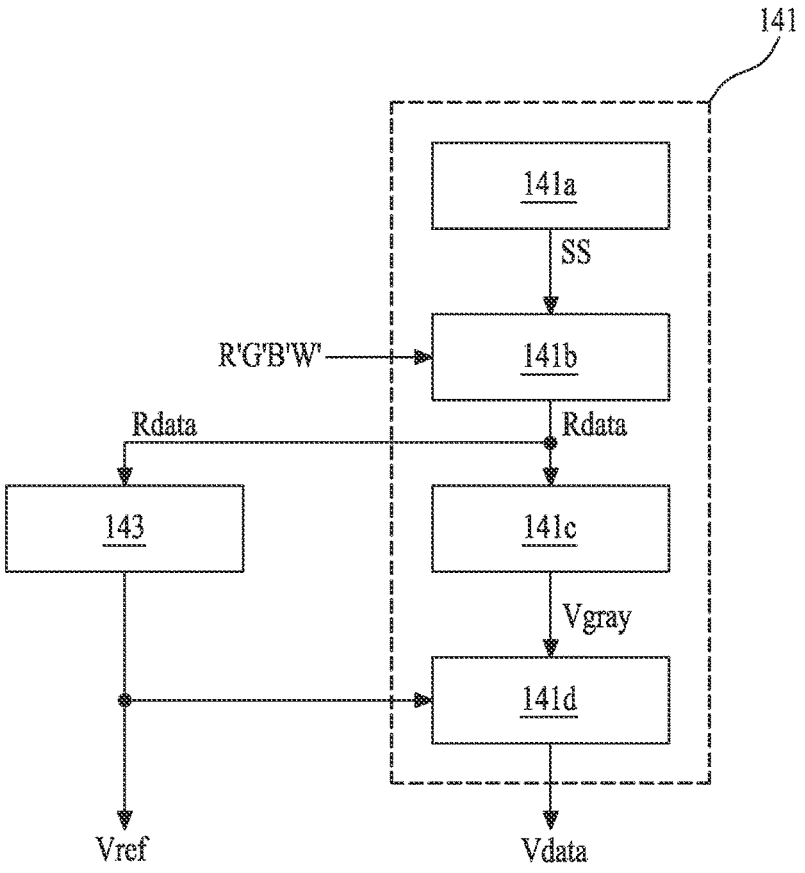
FIG. 6 is a block diagram for describing an example of a data voltage generator and an example of a reference voltage generator of FIG. 5.

The data driver 140 varies the reference voltage Vref according to display data R'G'B'W' (i.e., a voltage which is applied between the gate electrode and source electrode of the driving transistor DT) of each pixel P to lower a data voltage Vdata, supplied to the source electrode of the driving transistor DT, as much as possible, and thus prevents the organic light emitting device OLED from emitting light due to a data voltage higher than the threshold voltage of the organic light emitting device OLED, thereby enhancing a contrast ratio. In detail, the data driver 140 converts the display data R'G'B'W', which are supplied from the timing controller 120 in units of one horizontal period, into analog grayscale voltages according to the data control signal DCS supplied from the timing controller 120. The data driver 140 generates the reference voltage Vref corresponding to the display data R'G'B'W' to supply the reference voltage Vref to the reference lines R[1] to R[i], and simultaneously corrects the grayscale voltages to data voltages according to the reference voltage Vref to respectively supply the data voltages to the data lines D[1] to D[i]. To this end, as illustrated in FIGS. 5 and 6, the data driver 140 includes a data voltage generator 141, a reference voltage generator 143, a sensing data generator 145, and first and second switching units 147 and 149.

The data voltage generator 141 converts the display data R'G'B'W', which are supplied from the timing controller 120 in units of one horizontal period, into the analog grayscale voltages according to the data control signal DCS supplied from the timing controller 120. The data driver 140 corrects the grayscale voltages to the data voltages according to the reference voltage Vref supplied from the reference voltage generator 143, and supplies the corrected data voltages to the first switching unit 147. To this end, the data voltage generator 141 includes a shift register 141*a*, a latch 141*b*, a digital-analog converter 141*c*, and a voltage corrector 141*d*.

The shift register 141*a* sequentially outputs a plurality of sampling signals SS by using a source start signal and a source shift clock which are included in the data control signal DCS. In detail, the shift register 141*a* shifts the source start signal according to the source shift clock to sequentially output the sampling signals SS.

The latch 141*b* sequentially samples the display data R'G'B'W' supplied the timing controller 120 according to the sampling signals SS supplied from the shift register 141*a*, and latches the sampled display data. The latch 141*b* simultaneously outputs latch data Rdata for one horizontal line according to a source output enable signal of the data control signal DCS.

The digital-analog converter 141*c* selects a grayscale voltage Vgray corresponding to the latch data Rdata from among a plurality of grayscale voltages supplied from a grayscale voltage generator (not shown), and outputs the selected grayscale voltage.

The voltage corrector 141*d* corrects the grayscale voltage Vgray according to the reference voltage Vref supplied from the reference voltage generator 143 to generate a data voltage Vdata, and supplies the generated data voltage Vdata to the first switching unit 147. That is, the voltage corrector 141*d* subtracts the grayscale voltage Vgray from the reference voltage Vref to generate the data voltage Vdata.

The reference voltage generator 143 receives the latch data Rdata from the data voltage generator 141 (i.e., the latch 141*b* of the data voltage generator 141), digital-analog converts the received latch data Rdata to generate reference voltages Vref1 and Vref2, and supplies the reference voltages Vref1 and Vref2 to the reference lines R[1] and R[2]. That is, the reference voltage generator 143 may select a grayscale voltage corresponding to the latch data Rdata from among a plurality of grayscale voltages supplied from the grayscale voltage generator. Here, the latch data Rdata may not be supplied to the reference voltage generator 143 by the latch 141*b* of the data voltage generator 141, and the display data R'G'B'W' may be supplied to the reference voltage generator 143 by the timing controller 120.

The sensing data generator 145 is connected to the data lines D[1] and D[2] of respective pixels P[1] and P[2] through the second switching unit 149 according to a control of the timing controller 120 based on the sensing mode of the organic light emitting display device, and senses currents or voltages the data lines D[1] and D[2] to generate sensing data Dsen corresponding to a characteristic change of each of the pixels P[1] and P[2]. The sensing data generator 145 supplies the sensing data Dsen to the timing controller 120. That is, the sensing data Dsen is stored in the memory by the timing controller 120, and in the display mode of the organic light emitting display device, the sensing data Dsen is reflected in the four-color data RGBW. Here, the sensing mode may be performed in a test process before the product release of an organic light emitting display device, by a user's setting, or during a blank interval between the sensing mode and the display mode, but may be set to correct a characteristic change of each pixel in real time or periodically without being limited thereto.

The first switching unit 147 is turned on according to a display mode signal supplied from the timing controller 120, and connects the data voltage generator 141 to the data lines D[1] and D[2] of the respective pixels P[1] and P[2]. To this end, the first switching unit 147 may include a plurality of first switches which are turned on according to the display mode signal.

The second switching unit 149 is turned on according to a sensing mode signal supplied from the timing controller 120, and connects the sensing data generator 145 to the data lines D[1] and D[2] of the respective pixels P[1] and P[2]. To this end, the second switching unit 149 may include a plurality of second switches which are turned on according to the sensing mode signal.

Figure 7:
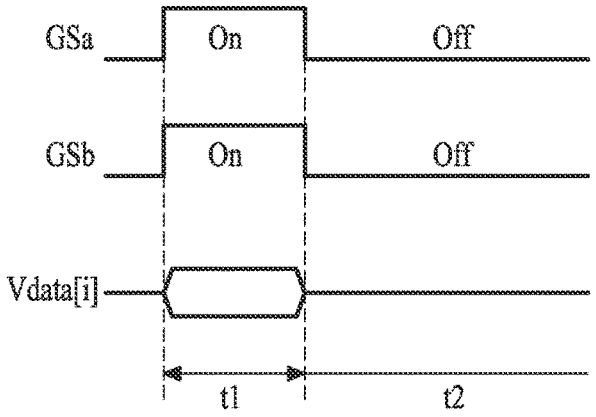
FIG. 7 is a waveform diagram showing a driving waveform in a display mode of an organic light emitting display device according to an embodiment of the present invention.

FIG. 7 is a waveform diagram showing a driving waveform in a display mode of an organic light emitting display device according to an embodiment of the present invention.

Operations in a data charging period t1 and emission period t2 of a first pixel P[1] connected to a first gate line G[1] in the display mode will be described in detail below with reference to FIGS. 3 and 5 to 7.

In the data charging period t1, the first and second gate signals GSa and GSb having a gate-on voltage level are respectively supplied to the first and second gate signal lines Ga and Gb of the first gate line G[1] according to driving of the gate driver 130, and according to driving of the data driver 140, a first reference voltage Vref1 is supplied to a first reference line R[1], and simultaneously, a first data voltage Vdata[1] is supplied to a first data line D[1]. Therefore, the first and second switching transistors ST1 and ST2 of the first pixel P[1] are respectively turned on by the first and second gate signals GSa and GSb, and thus, the first reference voltage Vref1 is supplied to the first node n1, and the first data voltage Vdata[1] is supplied to the second node n2. Therefore, during the data charging period t1, a difference voltage "Vref1−Vdata[1]" between the first reference voltage Vref1 and the first data voltage Vdata[1] is charged into the capacitor Cst. Here, the first reference voltage Vref1 is varied to a grayscale voltage corresponding to display data of the first pixel P[1] by the data driver 140, and the first data voltage Vdata[1] has a voltage value which is corrected with the first reference voltage Vref1. Therefore, in the data charging period t1, the first data voltage Vdata[1] corrected by the first reference voltage Vref1 which is varied with the display data of the first pixel P[1] is supplied to the source electrode of the driving transistor DT, and thus, the organic light emitting device OLED does not emit light due to the first data voltage Vdata[1].

Subsequently, in the emission period t2, the first and second gate signals GSa and GSb having a gate-off voltage level are respectively supplied to the first and second gate signal lines Ga and Gb according to driving of the gate driver 130. Therefore, in the emission period t2, the first and second switching transistors ST1 and ST2 of the first pixel P[1] are respectively turned off by the first and second gate signals GSa and GSb, and thus, the driving transistor DT is turned on with a voltage stored in the capacitor Cst. Therefore, the turned-on driving transistor DT supplies a current, which is determined based on the difference voltage "Vref1−Vdata[1]" between the first reference voltage Vref1 and the first data voltage Vdata[1], to the organic light emitting device OLED to emit light from the organic light emitting device OLED. That is, in the emission period t2, when the first and second switching transistors ST1 and ST2 are turned off, a current flows in the driving transistor DT with the driving voltage EVDD, and the organic light emitting device OLED starts to emit light in proportion to the current, whereby a voltage of the second node n2 increases. A voltage of the first node n1 is increased up to the voltage of the second node n2 by capacitor Cst, and thus, a gate-source voltage "Vgs" of the driving transistor DT is constantly maintained by a voltage of the capacitor Cst, whereby the organic light emitting device OLED continuously emits light until a next data charging period t1.

In the display mode, the threshold voltage of the driving transistor DT of each pixel P is compensated for with data voltages corresponding to the display data R'G'B'W' in which the sensing data Dsen is reflected.

Figure 8:
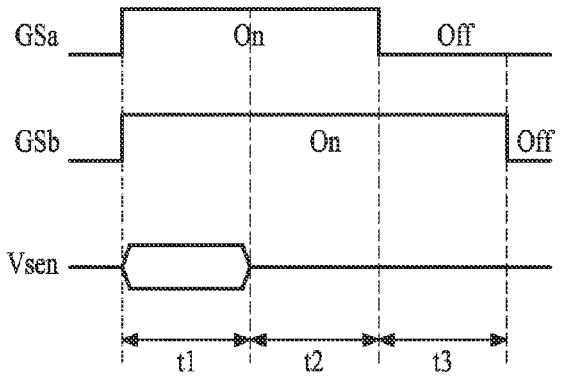
FIG. 8 is a waveform diagram showing a driving waveform in a sensing mode of an organic light emitting display device according to an embodiment of the present invention.

FIG. 8 is a waveform diagram showing a driving waveform in a sensing mode of an organic light emitting display device according to an embodiment of the present invention.

Operations in an initial period t1, charging period t2, and sensing period t3 of a first pixel P[1] connected to a first gate line G[1] in the sensing mode will be described in detail below with reference to FIGS. 3, 5, 6 and 8.

In the initial period t1, the first and second gate signals GSa and GSb having a gate-on voltage level are respectively supplied to the first and second gate signal lines Ga and Gb of the first gate line G[1] according to driving of the gate driver 130, and according to driving of the data driver 140, a sensing reference voltage Vref1 is supplied to the first reference line R[1], and simultaneously, a sensing data voltage Vsen is supplied to the first data line D[1]. Therefore, the first and second switching transistors ST1 and ST2 of the first pixel P[1] are respectively turned on by the first and second gate signals GSa and GSb, and thus, the sensing reference voltage Vref1 is supplied to the first node n1, and the sensing data voltage Vsen is supplied to the second node n2. Therefore, during the initial period t1, the capacitor Cst is initialized to a difference voltage "Vref1−Vsen" between the sensing reference voltage Vref1 and the sensing data voltage Vsen.

Subsequently, in the charging period t2, the first and second gate signals GSa and GSb having a gate-on voltage level are respectively supplied to the first and second gate signal lines Ga and Gb of the first gate line G[1] according to driving of the gate driver 130, and according to driving of the data driver 140, the sensing reference voltage Vref1 is continuously supplied to the first reference line R[1], and the first data line D[1] is floated accosting to turn-on of the first switching unit 147 of the data driver 140. Therefore, in the charging period t2, the driving transistor DT is turned on with the sensing reference voltage Vref1, and a voltage corresponding to a current which flows in the turned-on driving transistor DT is charged into the floated first data line D[1]. At this time, a voltage corresponding to the threshold voltage "Vth" of the driving transistor DT is charged into the first data line D[1].

Subsequently, in the sending period t3, the first gate signal GSa having a gate-off voltage level are respectively supplied to the first gate signal line Ga according to driving of the gate driver 130, and the second gate signal GSb supplied to the second gate signal line Gb is maintained at a gate-on voltage level. Simultaneously, the first data line D[1] of the first pixel P[1] is connected to the sensing data generator 145 through the second switching unit 149 of the data driver 140. Therefore, during the sensing period t3, the sensing data generator 145 senses a voltage charged into the first data line D[1], and converts the sensed voltage (i.e., a voltage corresponding to the threshold voltage of the driving transistor DT) into sensing data Dsen to supply the sensing data Dsen to the timing controller 120.

The timing controller 120 may detect the threshold voltage of the driving transistor DT of each pixel P in the sensing mode, and then may again perform the sensing mode for detecting a mobility of the driving transistor DT of each pixel P. In performing the sensing mode, the timing controller 120 controls the gate driver 130 and the data driver 140 so that the sensing reference voltage Vref1 is supplied in only the initial period t1. Therefore, in again performing the sensing mode, in the charging period t2, a gate-source voltage of the driving transistor DT increases according to turn-off of the first switching transistor ST1, and thus, the gate-source voltage of the driving transistor DT is maintained by the voltage of the capacitor Cst, whereby a voltage (i.e., a voltage corresponding to the mobility of the driving transistor DT) corresponding to a current flowing in the driving transistor DT is charged into the first data line D[1]. In performing the sensing mode, the sensing data generator 145 of the data driver 140 converts a voltage (i.e., a voltage corresponding to the mobility of the driving transistor DT), charged into the first data line D[1], into the sensing data Dsen to supply the sensing data Dsen to the timing controller 120.

In the organic light emitting display device according to an embodiment of the present invention, a reference voltage supplied to the reference line of each pixel is varied according to the display data R'G'B'W' (i.e., a voltage applied between the gate electrode and source electrode of the driving transistor) of each pixel P, and thus, a data voltage supplied to the source electrode of the driving transistor DT is lowered as much as possible, thereby preventing a contrast ratio from being reduced because the organic light emitting device OLED emits light with a data voltage higher than the threshold voltage of the organic light emitting device OLED.

Figure 9:
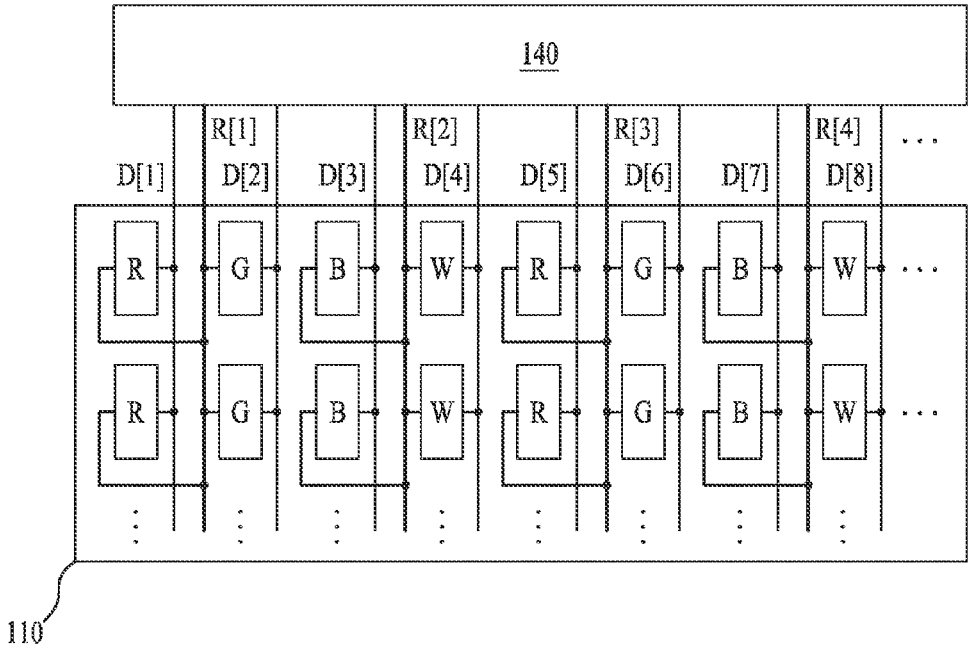
FIGS. 9 to 11 are diagrams for describing an organic light emitting display device according to another embodiment of the present invention.
Figure 10:
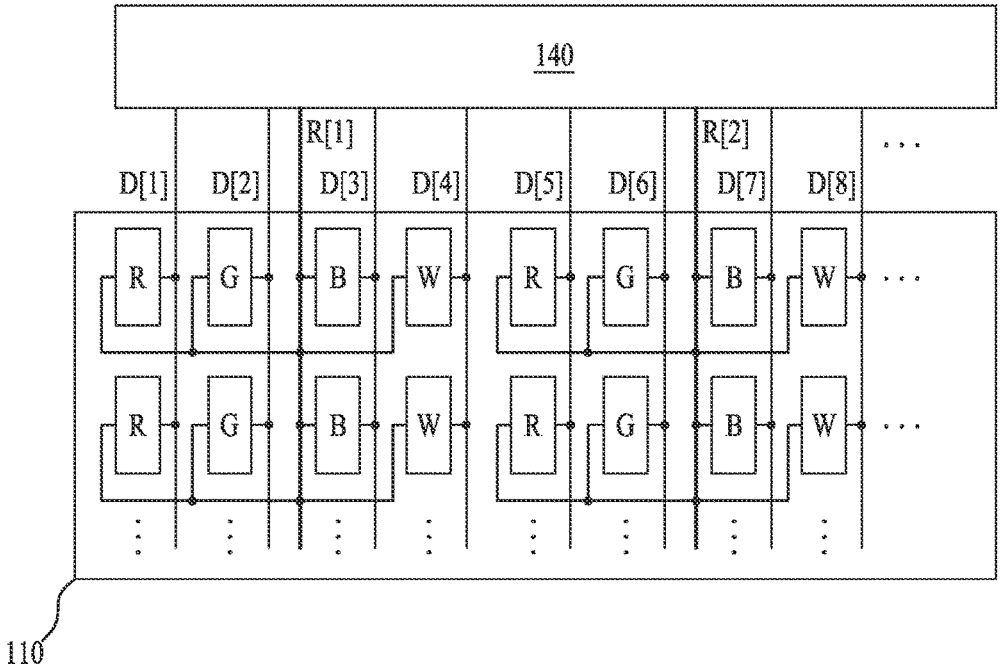
Figure 11:
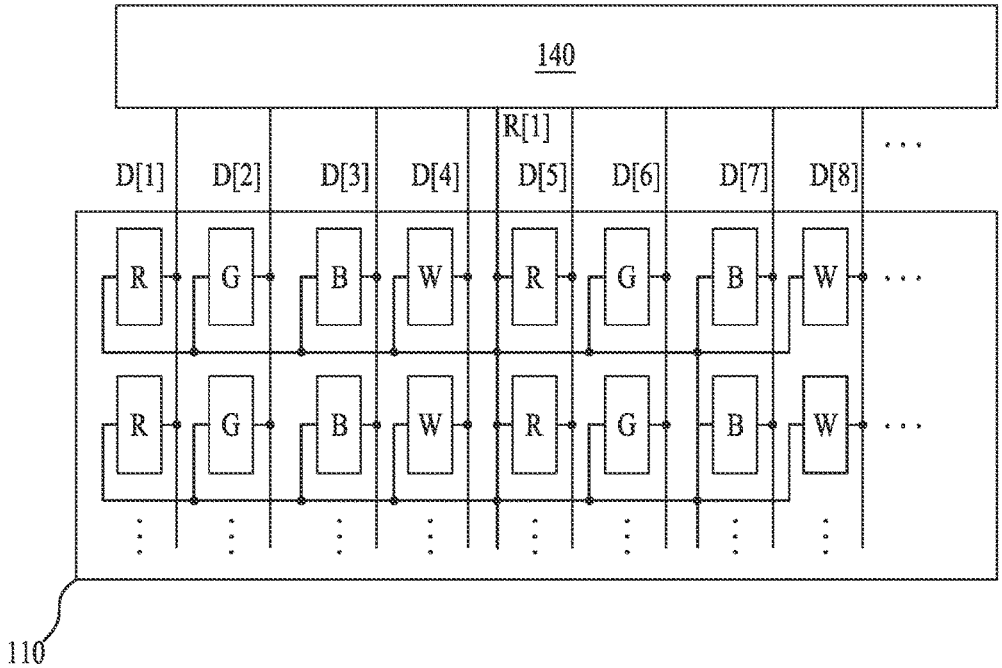

FIGS. 9 to 11 are diagrams for describing an organic light emitting display device according to another embodiment of the present invention, and illustrate a changed structure of the reference line connected to each pixel for increasing an aperture ratio of each pixel. Hereinafter, only a different configuration will be described.

As seen in FIGS. 9 to 11, in organic light emitting display device according to another embodiment of the present invention, each of a plurality of reference lines R[1], . . . may be formed to be shared by two, four, or eight pixels in a length direction of a gate line. Furthermore, although not shown, each of the reference lines R[1], . . . may be formed to be shared by three, six, or nine pixels in the length direction of the gate line. As a result, one reference line may be formed to be shared by at least two pixels adjacent thereto depending on the number of pixels configuring a unit pixel or an emission characteristic of each pixel.

In the organic light emitting display device according to another embodiment of the present invention, the data driver 140 supplies a reference voltage to the plurality of reference lines R[1], . . . shared by at least two adjacent pixels. In this case, the data driver 140 varies the reference voltage according to display data of pixels sharing each of the plurality of reference lines R[1], . . . , and supplies the varied reference voltage to each reference line. The data driver 140 corrects data voltages, which are to be supplied to respective pixels, according to the varied reference voltage, and supplies the corrected data voltages to a plurality of data lines D[1] to D[8], . . . . Here, the data driver 140 may generate or vary the reference voltage as a voltage corresponding to display data having the highest grayscale value among pieces of display data of pixels shared by each reference line. Hereinafter, as an example of the organic light emitting display device according to another embodiment of the present invention illustrated in FIG. 9, the data driver 140 will be described in detail.

Figure 12:
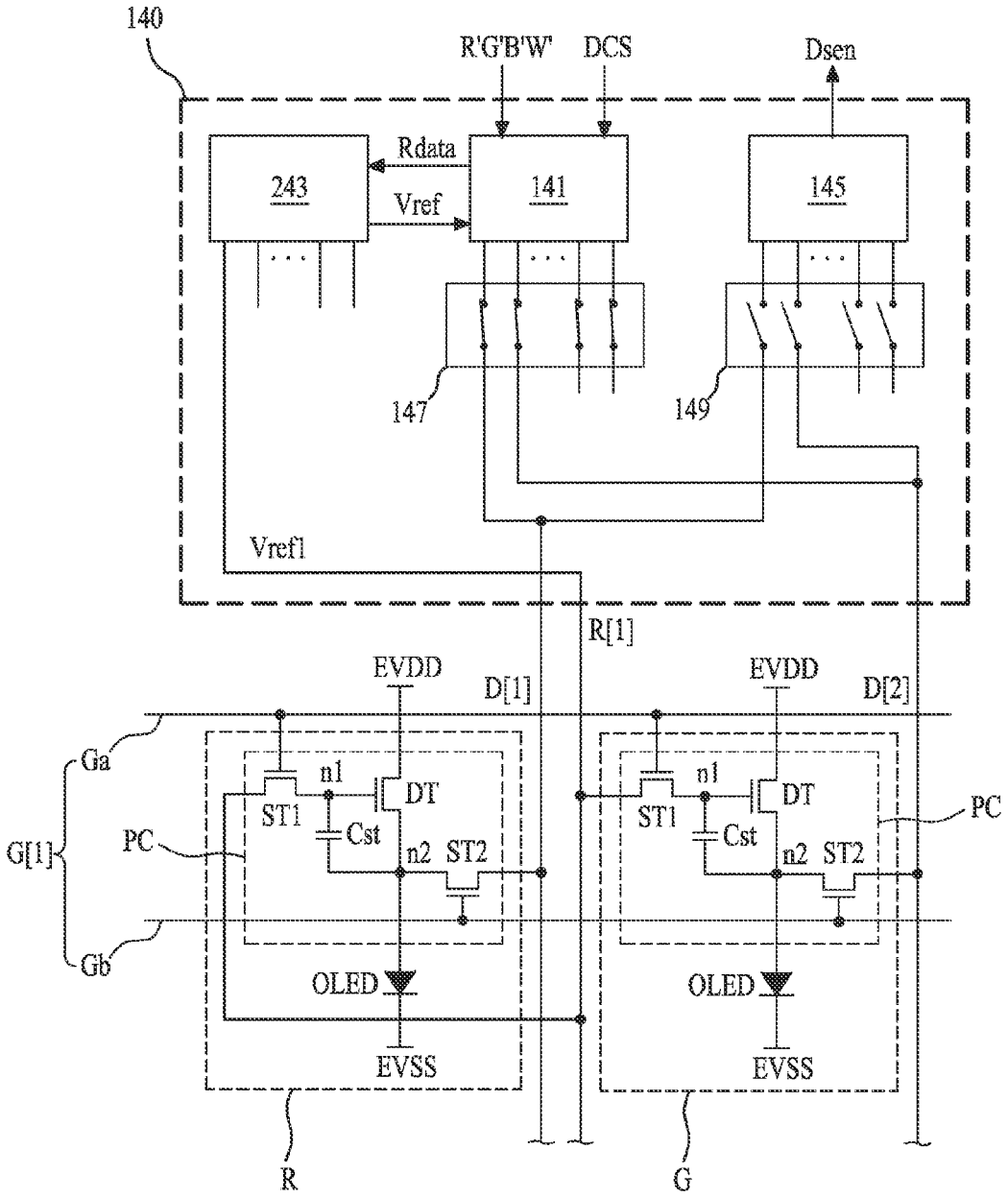
FIG. 12 is a diagram for describing an example of a data driver of FIG. 9.
Figure 13:
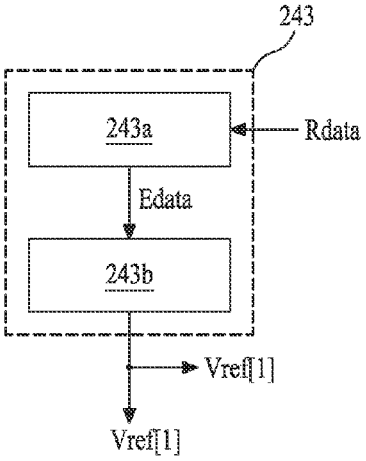
FIG. 13 is a diagram for describing an example of a reference voltage generator of FIG. 12.

As illustrated in FIGS. 12 and 13, the data driver 140 may include the data voltage generator 141, a reference voltage generator 243, the sensing data generator 145, and the first and second switching units 147 and 149. Here, except the reference voltage generator 243, the other elements are the same as the elements of the data driver of FIG. 5, and thus, their descriptions are not repeated.

The reference voltage generator 243 receives latch data Rdata from the latch 141*b* of the data voltage generator 141, extracts latch data having the highest grayscale value from among pieces of latch data Rdata of two pixels R and G shared by the reference line R[1], digital-analog converts the extracted extraction data Edata to generate the reference voltage Vref1, and supplies the generated reference voltage Vref1 to the reference line R[1] and the data voltage generator 141. To this end, the reference voltage generator 243 may include a data extractor 243*a* and a digital-analog converter 243*b*.

The data extractor 243*a* receives the latch data Rdata from the latch 141*b* of the data voltage generator 141 in units of one horizontal period, and extracts latch data having the highest grayscale value from among pieces of latch data Rdata of two pixels R and G shared by the reference line R[1].

The digital-analog converter 243*b* digital-analog converts the extracted extraction data Edata to generate the reference voltage Vref1, and supplies the generated reference voltage Vref1 to the reference line R[1] and the data voltage generator 141.

On the other hand, the data extractor 243*a* of the reference voltage generator 243 may be built into the timing controller 120. In this case, the timing controller 120 corrects the display data of the shared two pixels R and G according to the extraction data Edata extracted by the data extractor 243*a*, and supplies the corrected display data to the data driver 140. The data driver 140 latches the corrected display data supplied from the timing controller 120, and converts the latched data into a data voltage to supply the data voltage to a data line. The data driver 140 may be configured with the shift register 141*a*, the latch 141*b*, and the digital-analog converter 141*c* except the voltage corrector 141*d* in FIG. 6.

In a pixel structure of FIG. 10, the reference voltage generator 243 extracts latch data having the highest grayscale value from among pieces of latched Rdata of four pixels R, G, B and W sharing each of the reference lines R[1], R[2], R[3], R[4], . . . , and digital-analog converts the extracted extraction data Edata to generate the reference voltage Vref1.

In a pixel structure of FIG. 11, the reference voltage generator 243 extracts latch data having the highest grayscale value from among pieces of latched Rdata of eight pixels R, G, B, W, R, G, B and W sharing each of the reference lines R[1], R[2], R[3], R[4], . . . , and digital-analog converts the extracted extraction data Edata to generate the reference voltage Vref1.

On the other hand, in the data driver 140 of the organic light emitting display device according to another embodiment of the present invention illustrated in FIGS. 9 to 11, except that the data driver 140 time-division drives data lines of respective pixels sharing one reference line at every horizontal period to sequentially sense a characteristic change(s) of the driving transistor and/or organic light emitting device OLED of each of the pixels sharing the one reference line in the sensing mode, the description of the sensing mode made above with reference to FIG. 8 is the same, and is not repeated.

Figure 14:
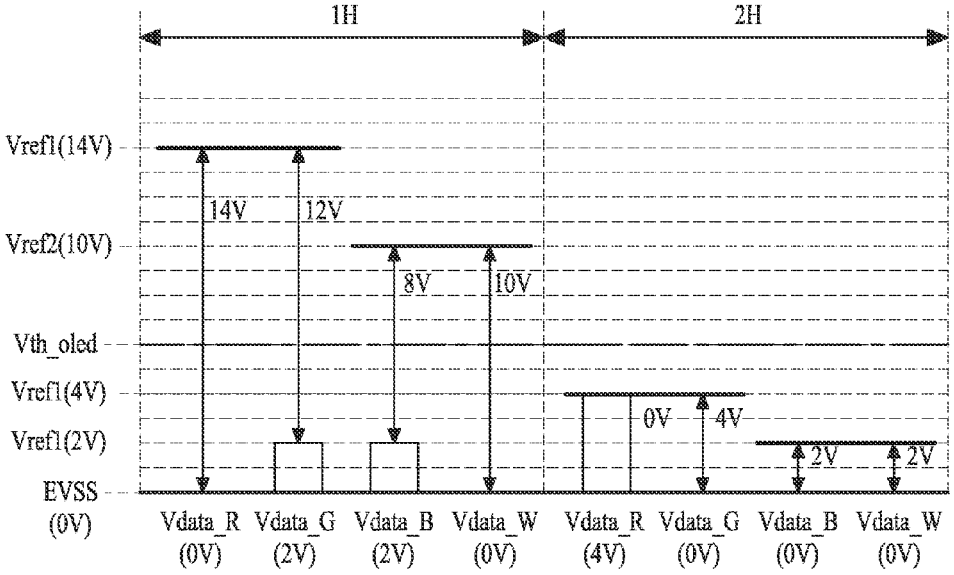
FIG. 14 is a waveform diagram showing a data voltage of a unit pixel for realizing a high gray scale and a low gray scale in one unit pixel, in the organic light emitting display device according to another embodiment of the present invention illustrated in FIG. 9.

FIG. 14 is a waveform diagram showing a data voltage of a unit pixel for realizing a high gray scale and a low gray scale in one unit pixel, in the organic light emitting display device according to another embodiment of the present invention illustrated in FIG. 9.

A voltage for realizing a high gray scale and low gray scale of the organic light emitting display device according to another embodiment of the present invention will be described in detail below with common reference to FIGS. 9 and 14.

First, it is assumed that a high gray scale having relatively high luminance is realized in a first horizontal period 1H and a low gray scale having relatively low luminance is realized in a second horizontal period 2H, as described above, the first reference voltage Vref1 supplied to the first reference line R[1] shared by adjacent red and green pixels is varied according to display data of the adjacent red and green pixels, and the second reference voltage Vref2 supplied to the second reference line R[2] shared by adjacent blue and white pixels is varied according to display data of the adjacent blue and white pixels. Also, a data voltage Vdata of each pixel is corrected to correspond to the varied first and second reference voltages Vref1 and Vref2.

During a data charging period of the first horizontal period 1H, the first reference voltage Vref1 set to 14V that is a voltage corresponding to the highest grayscale value among pieces of display data of adjacent red and green pixels R and G is supplied to the first reference line R[1], a red data voltage Vdata_R of 0V corrected according to the first reference voltage Vref1 of 14V is applied to the source electrode n2 of the driving transistor DT included in the red pixel R, and a red data voltage Vdata_G of 2V corrected according to the first reference voltage Vref1 of 14V is applied to the source electrode n2 of the driving transistor DT included in the green pixel G. Simultaneously, the second reference voltage Vref2 set to 10V that is a voltage corresponding to the highest grayscale value among pieces of display data of adjacent blue and white pixels B and W is supplied to the second reference line R[2], a blue data voltage Vdata_B of 2V corrected according to the second reference voltage Vref2 of 10V is applied to the source electrode n2 of the driving transistor DT included in the blue pixel B, and a white data voltage Vdata_W of 0V corrected according to the second reference voltage Vref2 of 0V is applied to the source electrode n2 of the driving transistor DT included in the white pixel W. Therefore, during the data charging period of the first horizontal period 1H, 14V "Vref−Vdata_R" is applied between the gate electrode and source electrode of the driving transistor included in the red pixel R, 12V "Vref−Vdata_G" is applied between the gate electrode and source electrode of the driving transistor included in the green pixel G, 8V "Vref−Vdata_B" is applied between the gate electrode and source electrode of the driving transistor included in the blue pixel B, and 10V "Vref−Vdata_W" is applied between the gate electrode and source electrode of the driving transistor included in the white pixel W. Therefore, in an emission period of the first horizontal period 1H, the organic light emitting devices OLED of the pixels R, G, B and W emit light with respective data currents corresponding to the voltages of 14V, 12V, 8V, and 10V, thereby realizing a high gray scale having high luminance.

Moreover, during a data charging period of the second horizontal period 2H, the first reference voltage Vref1 set to 4V that is a voltage corresponding to the highest grayscale value among pieces of display data of red and green pixels R and G shared by the first reference line R[1] is supplied to the first reference line R[1], a red data voltage Vdata_R of 4V corrected according to the first reference voltage Vref1 of 4V is applied to the source electrode n2 of the driving transistor DT included in the red pixel R, and a red data voltage Vdata_G of 0V corrected according to the first reference voltage Vref1 of 4V is applied to the source electrode n2 of the driving transistor DT included in the green pixel G. Simultaneously, the second reference voltage Vref2 set to 2V that is a voltage corresponding to the highest grayscale value among pieces of display data of blue and white pixels B and W shared by the second reference line R[2] is supplied to the second reference line R[2], a blue data voltage Vdata_B of 0V corrected according to the second reference voltage Vref2 of 2V is applied to the source electrode n2 of the driving transistor DT included in the blue pixel B, and a white data voltage Vdata_W of 0V corrected according to the second reference voltage Vref2 of 2V is applied to the source electrode n2 of the driving transistor DT included in the white pixel W. Therefore, during the data charging period of the second horizontal period 2H, 0V "Vref−Vdata_R" is applied between the gate electrode and source electrode of the driving transistor included in the red pixel R, 4V "Vref−Vdata_G" is applied between the gate electrode and source electrode of the driving transistor included in the green pixel G, 2V "Vref−Vdata_B" is applied between the gate electrode and source electrode of the driving transistor included in the blue pixel B, and 2V "Vref−Vdata_W" is applied between the gate electrode and source electrode of the driving transistor included in the white pixel W. Therefore, in an emission period of the second horizontal period 2H, the organic light emitting devices OLED of the pixels R, G, B and W emit light with respective data currents corresponding to the voltages of 0V, 4V, 2V, and 2V, thereby realizing a low gray scale having low luminance.

During the data charging period of each of the first and second horizontal periods 1H and 2H, a data voltage Vdata_R applied to the source electrode n2 of the driving transistor included in a red pixel is corrected to correspond to the first reference voltage Vref1 which is varied according to display data of two shared pixels, a data voltage Vdata_G applied to the source electrode n2 of the driving transistor included in a green pixel is corrected to correspond to the first reference voltage Vref1 which is varied according to display data of two shared pixels, a data voltage Vdata_B applied to the source electrode n2 of the driving transistor included in a blue pixel is corrected to correspond to the second reference voltage Vref2 which is varied according to display data of two shared pixels, and a data voltage Vdata_W applied to the source electrode n2 of the driving transistor included in a white pixel is corrected to correspond to the second reference voltage Vref2 which is varied according to display data of two shared pixels, whereby the corrected voltages are lower than the threshold voltage Vth_oled of the organic light emitting device OLED. Thus, the organic light emitting device OLED of each pixel does not emit light during the data charging period. Accordingly, the organic light emitting display device according to another embodiment of the present invention illustrated in FIG. 9 prevents the organic light emitting device OLED from emitting light during the data charging period, thereby enhancing a contrast ratio. Also, since one reference line is shared by two pixels, an aperture ratio of each pixel can increase.

Figure 15:
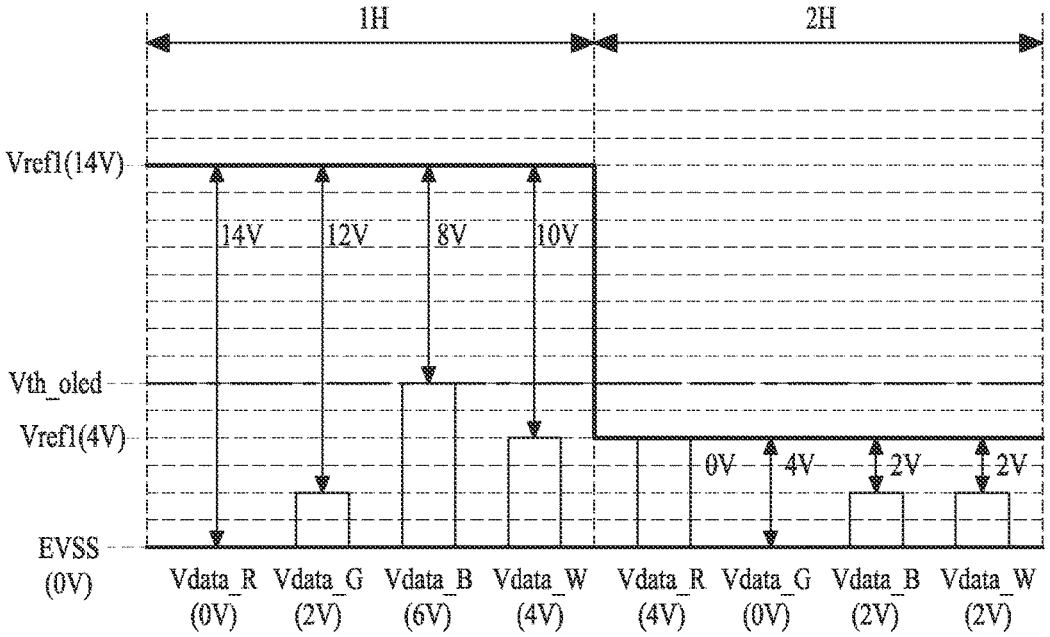
FIG. 15 is a waveform diagram showing a data voltage of a unit pixel for realizing a high gray scale and a low gray scale in one unit pixel, in the organic light emitting display device according to another embodiment of the present invention illustrated in FIG. 10.

FIG. 15 is a waveform diagram showing a data voltage of a unit pixel for realizing a high gray scale and a low gray scale in one unit pixel, in the organic light emitting display device according to another embodiment of the present invention illustrated in FIG. 10.

A voltage for realizing a high gray scale and low gray scale of the organic light emitting display device according to another embodiment of the present invention will be described in detail below with common reference to FIGS. 10 and 15.

First, it is assumed that a high gray scale having relatively high luminance is realized in a first horizontal period 1H and a low gray scale having relatively low luminance is realized in a second horizontal period 2H, as described above, the first reference voltage Vref1 supplied to the first reference line R[1] shared by adjacent four pixels of red, green, blue, and white is varied according to display data of the adjacent red, green, blue, and white pixels, and a data voltage Vdata of each pixel is corrected to correspond to the varied first reference voltage Vref1.

During the data charging period of the first horizontal period 1H, the first reference voltage Vref1 set to 14V that is a voltage corresponding to the highest grayscale value among pieces of display data of four pixels R, G, B and W of red, green, blue, and white shared by each of the reference lines R[1], R[2], . . . is supplied to the first reference line R[1], a red data voltage Vdata_R of 0V corrected according to the first reference voltage Vref1 of 14V is applied to the source electrode n2 of the driving transistor DT included in the red pixel R, a red data voltage Vdata_G of 2V corrected according to the first reference voltage Vref1 of 14V is applied to the source electrode n2 of the driving transistor DT included in the green pixel G, a blue data voltage Vdata_B of 6V corrected according to the first reference voltage Vref1 of 14V is applied to the source electrode n2 of the driving transistor DT included in the blue pixel B, and a white data voltage Vdata_W of 4V corrected according to the first reference voltage Vref1 of 14V is applied to the source electrode n2 of the driving transistor DT included in the white pixel W. Therefore, during the data charging period of the first horizontal period 1H, 14V "Vref−Vdata_R" is applied between the gate electrode and source electrode of the driving transistor included in the red pixel R among the pixels R, G, B and W sharing the first reference line R[1], 12V "Vref−Vdata_G" is applied between the gate electrode and source electrode of the driving transistor included in the green pixel G, 8V "Vref−Vdata_B" is applied between the gate electrode and source electrode of the driving transistor included in the blue pixel B, and 10V "Vref−Vdata_W" is applied between the gate electrode and source electrode of the driving transistor included in the white pixel W. Therefore, in an emission period of the first horizontal period 1H, the organic light emitting devices OLED of the pixels R, G, B and W emit light with respective data currents corresponding to the voltages of 14V, 12V, 8V, and 10V, thereby realizing a high gray scale having high luminance.

Moreover, during the data charging period of the second horizontal period 2H, the first reference voltage Vref1 set to 4V that is a voltage corresponding to the highest grayscale value among pieces of display data of four pixels R, G, B and W of red, green, blue, and white shared by each of the reference lines R[1], R[2], . . . is supplied to the first reference line R[1], a red data voltage Vdata_R of 4V corrected according to the first reference voltage Vref1 of 4V is applied to the source electrode n2 of the driving transistor DT included in the red pixel R, and a red data voltage Vdata_G of 0V corrected according to the first reference voltage Vref1 of 4V is applied to the source electrode n2 of the driving transistor DT included in the green pixel G, a red data voltage Vdata_B of 2V corrected according to the first reference voltage Vref1 of 4V is applied to the source electrode n2 of the driving transistor DT included in the blue pixel B, and a white data voltage Vdata_W of 2V corrected according to the first reference voltage Vref1 of 4V is applied to the source electrode n2 of the driving transistor DT included in the white pixel W. Therefore, during the data charging period of the second horizontal period 2H, 0V "Vref−Vdata_R" is applied between the gate electrode and source electrode of the driving transistor DT included in the red pixel R among the pixels R, G, B and W sharing the first reference line R[1], 4V "Vref−Vdata_G" is applied between the gate electrode and source electrode of the driving transistor included in the green pixel G, 2V "Vref−Vdata_B" is applied between the gate electrode and source electrode of the driving transistor included in the blue pixel B, and 2V "Vref−Vdata_W" is applied between the gate electrode and source electrode of the driving transistor included in the white pixel W. Therefore, in the emission period of the second horizontal period 2H, the organic light emitting devices OLED of the pixels R, G, B and W emit light with respective data currents corresponding to the voltages of 0V, 4V, 2V, and 2V, thereby realizing a low gray scale having low luminance.

During the data charging period of each of the first and second horizontal periods 1H and 2H, data voltages Vdata_R, Vdata_G, Vdata_B and Vdata_W respectively applied to the source electrodes n2 of the driving transistors included in respective pixels are corrected to correspond to respective reference voltages which are varied according to display data of four shared pixels R, G, B and W, and thus, the corrected voltages are lower than the threshold voltage Vth_oled of the organic light emitting device OLED, whereby the organic light emitting device OLED of each pixel does not emit light during the data charging period. Accordingly, the organic light emitting display device according to another embodiment of the present invention illustrated in FIG. 10 prevents the organic light emitting device OLED from emitting light during the data charging period, thereby enhancing a contrast ratio. Also, since one reference line is shared by four pixels, an aperture ratio of each pixel can increase.

On the other hand, in each horizontal period of the organic light emitting display device according to another embodiment of the present invention illustrated in FIG. 11, except that a reference voltage is varied according to display data of eight pixels R, G, B, W, R, G, B and W sharing each of the reference lines R[1], R[2], . . . and a data voltage of each pixel is corrected according to the reference voltage, the organic light emitting display device of FIG. 9 or 10 is the same, and its description is not repeated.

In the organic light emitting display device according to an embodiment of the present invention, a reference voltage supplied to the reference line of each pixel is varied according to the display data R'G'B'W' (i.e., a voltage applied between the gate electrode and source electrode of the driving transistor) of each pixel P, and thus, a data voltage supplied to the source electrode of the driving transistor DT is lowered as much as possible, thereby preventing a contrast ratio from being reduced because the organic light emitting device OLED emits light with a data voltage higher than the threshold voltage of the organic light emitting device OLED.

As described above, in each pixel, by varying a reference voltage according to a voltage applied between a gate electrode and source electrode of a driving transistor, a data voltage supplied to the source electrode of the driving transistor is lowered as much as possible, thereby preventing a contrast ratio from being reduced due to undesired emission of light from an organic light emitting device in realizing a low gray scale.

Moreover, according to the embodiments of the present invention, one reference line is shared by at least two pixels, thereby increasing an aperture ratio of each pixel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a plurality of pixels configured to each include an organic light emitting device which emits light with a data current, and a pixel circuit that includes a driving transistor which supplies the data current, which is based on a difference voltage between a data voltage and a reference voltage, to the organic light emitting device;

a plurality of data lines configured to supply the data voltage to a source electrode of the driving transistor of the plurality of pixels in a data charging period of a display mode, respectively, the plurality of data lines being operatively connected to a data voltage generator in the data charging period of the display mode and connected to a sensing data generator in a sensing mode;

a plurality of gate lines configured to supply a gate signal to the plurality of pixels; and a plurality of reference lines connected to at least one of the plurality of pixels and to a single reference voltage generator, and configured to supply the reference voltage to a gate electrode of the driving transistor of the connected pixel in the data charging period of the display mode, wherein each of the plurality of reference lines is shared by at least two pixels adjacent thereto, and wherein in the display mode, the reference voltage is varied according to data of shared pixels connected to a corresponding reference line, and the data voltage is corrected according to the varied reference voltage.

2. The organic light emitting display device of claim 1, wherein, the plurality of reference lines are respectively connected to the plurality of pixels, and the reference voltage is varied according to data of a corresponding pixel.

3. The organic light emitting display device of claim 2, wherein, the reference voltage is supplied to the gate electrode of the driving transistor, and the data voltage is supplied to the source electrode of the driving transistor connected to the organic light emitting device.

4. The organic light emitting display device of claim 2, further comprising a data driver connected to the plurality of reference lines and the plurality of data lines, wherein the data driver comprises:

the data voltage generator configured to latch input data of each of the plurality of pixels to generate latch data, convert the latch data into an analog grayscale voltage, correct the analog grayscale voltage according to the varied reference voltage to generate the data voltage, and supply the generated data voltage to a corresponding data line;

the reference voltage generator configured to convert the latch data, supplied from the data voltage generator, into the reference voltage, and supply the converted reference voltage to a corresponding reference line and the data voltage generator;

the sensing data generator configured to sense a characteristic change of a corresponding pixel through each of the plurality of data lines to generate sensing data, and output the generated sensing data to an outside;

a first switching unit configured to connect the plurality of data lines to the data voltage generator; and a second switching unit configured to connect the plurality of data lines to the sensing data generator.

5. The organic light emitting display device of claim 1, wherein the reference voltage is varied to the same voltage as a data voltage which corresponds to data having a highest grayscale value among pieces of data of the shared pixels.

6. The organic light emitting display device of claim 1, further comprising a data driver connected to the plurality of reference lines and the plurality of data lines, wherein the data driver comprises:

the data voltage generator configured to latch input data of each of the plurality of pixels to generate latch data, convert the latch data into an analog grayscale voltage, correct the analog grayscale voltage according to the varied reference voltage to generate the data voltage, and supply the generated data voltage to a corresponding data line;

the reference voltage generator configured to extract latch data, having a highest grayscale value among pieces of latch data of the shared pixels, from the latch data supplied from the data voltage generator, convert the extracted extraction data into the reference voltage, and supply the converted reference voltage to a corresponding reference line and the data voltage generator;

the sensing data generator configured to sense a characteristic change of a corresponding pixel through each of the plurality of data lines to generate sensing data, and output the generated sensing data to an outside;

a first switching unit configured to connect the plurality of data lines to the data voltage generator; and a second switching unit configured to connect the plurality of data lines to the sensing data generator.

7. An organic light emitting display device comprising:

a display panel configured to include a plurality of pixels, which are respectively connected to a plurality of data lines receiving a data voltage, and a plurality of reference lines shared by and connected to at least two pixels among the plurality of pixels, wherein the plurality of reference lines are connected to a single reference voltage generator, and each pixel includes an organic light emitting device which emits light with a data current and a pixel circuit that includes a driving transistor which supplies the data current; and a data driver configured to vary a reference voltage supplied to each of the plurality of reference lines according to data of shared pixels sharing each of the plurality of reference lines, and correct a data voltage of each of the plurality of pixels according to the varied reference voltage to supply the corrected data voltage to a corresponding data line, wherein the corrected data voltage is supplied to a source electrode of the driving transistor via the data line and the reference voltage is supplied to a gate electrode of the driving transistor of the connected pixel via the reference line in a data charging period of a display mode, and wherein the plurality of data lines are operatively connected to a data voltage generator in the data charging period of the display mode and connected to a sensing data generator in a sensing mode.

8. The organic light emitting display device of claim 7, wherein the data driver varies the reference voltage according to a data voltage which corresponds to data having a highest grayscale value among pieces of data of pixels sharing a corresponding reference line.

9. The organic light emitting display device of claim 7, wherein in the sensing mode, the data driver time-division drives data lines of pixels sharing each of the plurality of reference lines, sequentially senses characteristic changes of the pixels sharing each reference line through the time-division driven data lines, and outputs the sensed characteristic changes.

10. The organic light emitting display device of claim 7, wherein the data current is based on a difference voltage between the data voltage and the reference voltage and is supplied to the organic light emitting device.

11. The organic light emitting display device of claim 10, wherein, the reference voltage is varied according to data of the shared pixels, and the data voltage is corrected according to the varied reference voltage.

12. The organic light emitting display device of claim 10, wherein the data driver comprises:

the data voltage generator configured to latch input data of each of the plurality of pixels to generate latch data, convert the latch data into an analog grayscale voltage, correct the analog grayscale voltage according to the varied reference voltage to generate the data voltage, and supply the generated data voltage to a corresponding data line;

the reference voltage generator configured to extract latch data, having a highest grayscale value among pieces of latch data of the shared pixels, from the latch data supplied from the data voltage generator, convert the extracted extraction data into the reference voltage, and supply the converted reference voltage to a corresponding reference line and the data voltage generator;

the sensing data generator configured to sense a characteristic change of a corresponding pixel through each of the plurality of data lines to generate sensing data, and output the generated sensing data to an outside;

a first switching unit configured to connect the plurality of data lines to the data voltage generator; and a second switching unit configured to connect the plurality of data lines to the sensing data generator.

* * * * *